US005396719A

United States Patent [19]

Crawford, III

[11] Patent Number: 5,396,719

[45] Date of Patent: Mar. 14, 1995

[54] APPARATUS FOR MAINTAINING THE TUCKBOARD OF FOOTWEAR IN A PARTICULAR SHAPE

[75] Inventor: Howard E. Crawford, III, Calabasas, Calif.

[73] Assignee: Medical Materials Corporation, Camarillo, Calif.

[21] Appl. No.: 986,253

[22] Filed: Dec. 7, 1992

[51] Int. Cl.[6] ..... A43B 13/42; A43B 23/00; A43B 23/22

[52] U.S. Cl. ..... 36/76 R; 36/108

[58] Field of Search ..... 36/107, 108, 76 R, 76 C, 36/43, 44, 149, 151, 152; 12/146 S

[56] References Cited

U.S. PATENT DOCUMENTS

| | | | |
|---|---|---|---|
| 2,173,967 | 9/1939 | King | 36/76 C X |
| 2,644,250 | 7/1953 | Ciaio | 36/76 C |
| 3,091,872 | 6/1963 | Baumann et al. | 36/76 R |
| 3,757,435 | 9/1973 | Schwartz | 36/30 R |
| 3,835,558 | 9/1974 | Reviu | 36/44 |
| 4,199,878 | 4/1980 | Wossner | 36/44 X |
| 4,231,169 | 11/1980 | Toyama et al. | 36/76 C X |
| 4,404,702 | 9/1983 | Clayman et al. | 36/44 X |
| 5,204,173 | 4/1993 | Canary | 36/44 X |

*Primary Examiner*—Steven N. Meyers
*Assistant Examiner*—BethAnne C. Cicconi
*Attorney, Agent, or Firm*—Ellsworth R. Roston; Charles H. Schwartz

[57] ABSTRACT

Apparatus is provided for maintaining the tuckboard of footwear in a particular shape. The apparatus includes a tuckboard member made from a sheet of deformable material such as a fiberboard. Retention members are attached to the opposite surfaces of the tuckboard at localized positions such as where the tuckboard has been or is to be deformed. One of the retention members is in compression and the other is in tension. Each of the retention members may be thermosetting or a thermoplastic composite material formed from fibers (preferably non-woven) impregnated and covered with a thermoplastic material. The fibers may be made from a material selected from the group consisting of carbon, glass and aramid. The thermoplastic material may be an acrylic, nylon, polycarbonate or ABS. The retention members help to maintain the tuckboard in a particular shape. The retention members may be initially attached to the tuckboard, and the retention members and the tuckwear may subsequently be deformed to the desired shape. Alternatively, the tuckboard and the retention members may be separately deformed to the desired shapes initially and the retention members may be subsequently attached to the tuckboard. In either alternative, the inner sole and the outsole are then attached to the tuckboard. This embodiment has a particular utility to ladies shoes.

3 Claims, 2 Drawing Sheets 10
21
14
4
20
16
4
18
12
3
22
3
28
26
24

25
32
28
24
30

34
26
40
32
28
30
24a
24b

FIG. 5
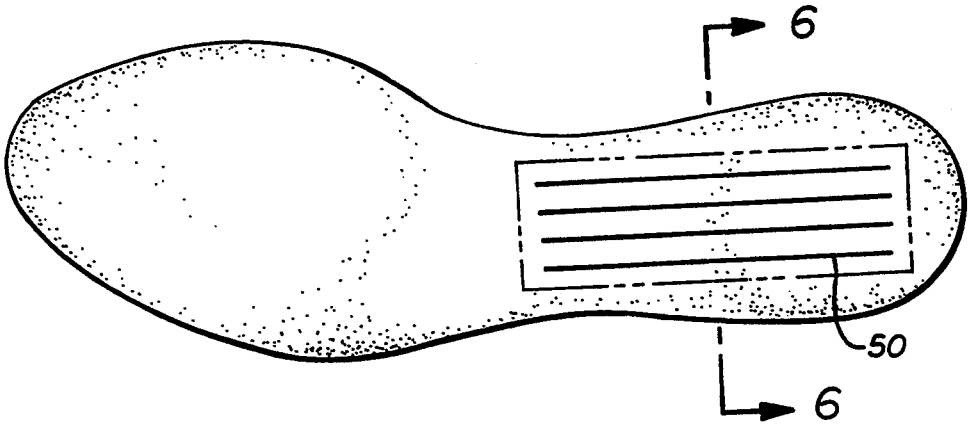
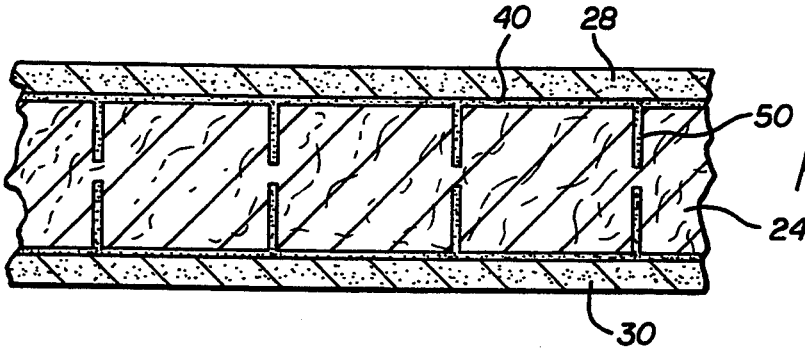
FIG. 6
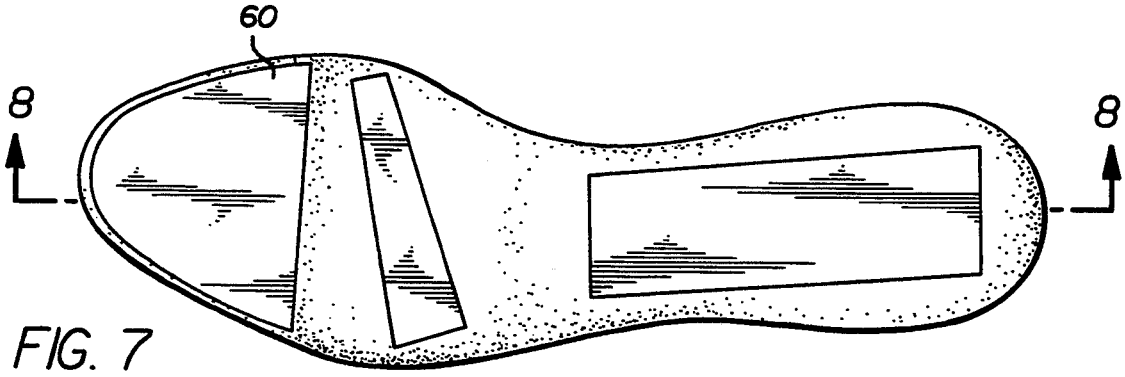
FIG. 7
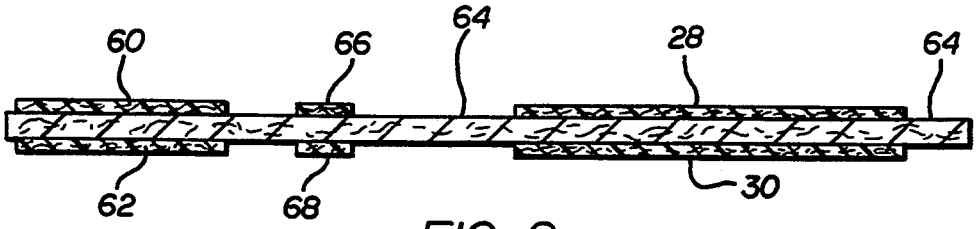
FIG. 8

APPARATUS FOR MAINTAINING THE TUCKBOARD OF FOOTWEAR IN A PARTICULAR SHAPE

This invention relates to apparatus which is light in weight and is minimal in space and which can be deformed to any desired shape and which can then receive considerable weights without becoming deformed from the desired shape. The invention also relates to methods of forming such apparatus. The apparatus and method have particular utility in footwear.

Ladies shoes are more complex in construction and manufacture than a casual inspection would indicate. For example, the inner sole, the tuckboard and the outsole of a ladies shoe are quite light and thin. When there is a high heel attached to the outsole, the ball portion of the outsole has to be relatively flat. The arch support portion then has to curve upwardly in a relatively small distance from the flat ball portion through a relatively large angle to the heel portion. The heel portion of the outsole has to be relatively flat to receive and support the heel.

To maintain the configuration of the sole of a ladies shoe in the highly curved configuration discussed in the previous paragraph, a metallic shank (or clamp) has been attached to the outsole member. The metallic clamp has been relatively thick and heavy. The metallic clamp has been shielded from view by the outsole and the inner sole. The metallic clamp sometimes provides a protuberance in the outsole when the ladies shoe is viewed from the side on an elevational basis.

The use of the tuckboard and the metallic clamp has been disadvantageous in certain important respects. It has increased the weight of the shoe. The metal clamp does not prevent torsional profile distortion of the ladies shoe. The metallic clamp also offers other intrinsic disadvantages since a customer would be concerned if she knew that there was a heavy metal clamp which was hidden in the bottom of her shoe and which could potentially damage her foot. The manufacturers of footwear have known of these disadvantages for some time and have attempted to provide other solutions to the problems discussed above. These attempts have been largely unsuccessful.

In one embodiment of the invention, apparatus is provided for maintaining the tuckboard of footwear in a particular shape. The apparatus includes a tuckboard made from a sheet of deformable material such as a fiberboard. Retention members are attached to the opposite surfaces of the tuckboard at localized positions such as where the tuckboard has been or is to be deformed. One of the retention members is in compression and the other is in tension.

Each of the retention members may be thermosetting or a thermoplastic composite material formed from fibers (preferably non-woven) impregnated and covered with a plastic material. The fibers may be made from a material selected from the group consisting of carbon, glass and aramid. The thermoplastic may be an acrylic, nylon, polycarbonate or ABS. The retention members help to maintain the tuckboard in a particular shape.

The retention members may be initially attached to the tuckboard and the retention members and the tuckboard may subsequently be deformed to the desired shape. Alternatively, the tuckboard and the retention members may be separately deformed to the desired shape initially and the retention members may be subsequently attached to the tuckboard. In either alternative, the inner sole and the outsole are then attached to the tuckboard. This embodiment has particular utility to ladies shoes, boots, hiking shoes, etc.

In other embodiments, the retention members may be attached to the tuckboard at other positions in the footwear such as at the ball portion or tip of the footwear. The resultant footwear may be used for a wide variety of applications such as for athletic shoes worn on artificial turf.

In the drawings:

FIG. 5 is a plan view of a tuckboard included in another embodiment of the invention;

FIG. 6 is a sectional view of the tuckboard shown in FIG. 5 and is taken substantially on the line 6—6 of FIG. 5;

FIG. 7 is a plan view of a tuckboard included in still another embodiment of the invention; and FIG. 8 is a sectional view of the tuckboard shown in FIG. 7 and is taken substantially on the line 8—8 of FIG. 7.

Figures 1, 2, 3, 4:
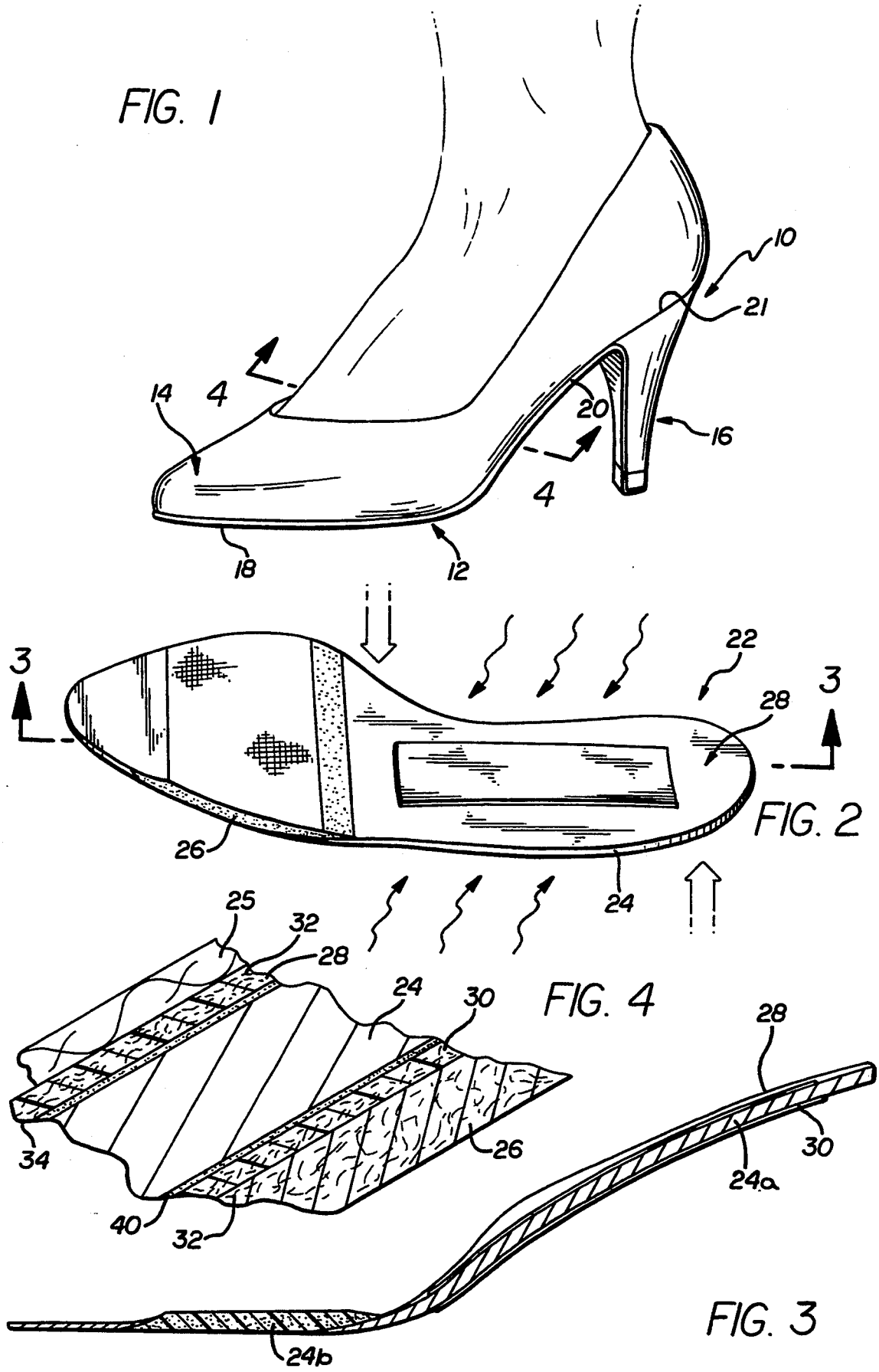
FIG. 1 is a perspective view of a ladies shoe and a portion of the foot of the person wearing the shoe.
FIG. 2 is a plan view of members included in one embodiment of the invention for use in footwear such as in a ladies shoe.
FIG. 3 is a sectional view taken substantially on the line 3—3 of FIG. 2 and illustrates in further detail the construction of the apparatus shown in FIG. 2.
FIG. 4 is an enlarged fragmentary sectional view, similar to that shown in FIG. 3, and is taken substantially on the line 4—4 of FIG. 1.

In one embodiment of the invention a ladies shoe is generally indicated at 10 in FIG. 1. The ladies shoe is only indicative of the invention since the invention is applicable to footwear in general. The ladies shoe 10 includes a sole generally indicated at 12, a top enclosure generally indicated at 14 and a heel generally indicated at 16. As will be seen, the sole 12 bends through a sharp angle in an arch support region 20 between a ball portion 18 and a heel portion 21 of the sole 12. One embodiment of this invention provides apparatus generally indicated at 22 in FIG. 2 for maintaining this sharp angle in the arch support region 20 of the sole 12.

The apparatus 22 includes a tuckboard 24 included in the sole 12 and shaped laterally and longitudinally to conform to the configuration of the sole 12. The tuckboard 24 is generally included in the footwear of the prior art. The tuckboard 24 may be made from a deformable material which provides some strength even when deformed. Preferably the tuckboard 24 is made from a suitable material such as a fiberboard having a suitable thickness such as a thickness of approximately one eighth of an inch ($\frac{1}{8}$"). However, the tuckboard 24 may also be made from other materials such as paperboard, plastic or foam. The thickness of the fiberboard may vary in a range between approximately fifty mils (0.050") and approximately two hundred mils (0.200").

The tuckboard 24 may extend the full length of the sole. Preferably, however, the tuckboard 24 comprises two parts one of which extends to the ball portion 18 of the sole 12. This portion is designated as **24*a* in FIG. 3. At the ball portion 18 of the sole 12, the portion 24*a* is preferably attached to a portion 24*b* which has compressible, pliant and resilient properties to provide a cushioning effect on the sole of the shoe when a person is wearing the shoe. An inner sole 25 and an outsole 26** may be respectively attached to the inner and outer surfaces of the tuckboard 24 in a conventional manner to form the sole 12. The tuckboard 24, the inner sole 25 and the outsole 26 are known in the prior art since this is generally how footwear is made.

In the embodiment shown in FIGS. 1–4, retention members generally indicated at 28 and 30 are attached to the tuckboard 24 at localized positions on the opposite surfaces of the tuckboard before the inner sole 25 and the outsole 26 are attached to the tuckboard. These localized positions correspond to the arch support portion of the tuckboard 24 in the embodiment of the invention shown in FIGS. 1–4. Each of the retention members 28 and 30 may have a suitable length such as approximately four (4) inches and a suitable width such as approximately one (1) inch to extend between the ball portion 18 and the heel portion 20 of the sole 12. The combined thicknesses of the retention members 28 and 30 are preferably less than the thickness of the tuckboard 24 since each retention member may be only a few relatively few mils thick.

The retention member 30 is generally under tension and the compression member 28 is generally under compression even though both can be put under tension or compression. The retention members 28 and 30 may be made from any strong and light material. Probably the material of the retention members 28 and 30 will be a plastic material but the plastic material may be thermosetting or thermoplastic. When a thermosetting material is used, the thermosetting material may be an epoxy.

Each of the retention members 28 and 30 preferably constitutes a thermoplastic composite material. The thermoplastic composite material of the retention members 28 and 30 may include fibers 32 which are preferably non-woven and which may be unidirectional. However, the fibers 32 may not be unidirectional if it is desired to provide torsional constraints in the shoe 10 through the use of the retention members. The fibers 32 may be made from a suitable material such as a material selected from the group consisting of carbon, glass and aramid.

The fibers 32 preferably have a density in the retention members 28 and 30 of approximately one hundred grams per square meter (100 $g/m^2$). However, the density of the fibers 32 in the retention members 28 and 30 may vary through a suitable range such as approximately fifty grams per square meter (50 $g/m^2$) to approximately two hundred and fifty grams per square meter (250 $g/m^2$). The fibers 32 may have a thickness in the order of approximately five mils (0.005") although the thickness of the fibers may vary in a range between approximately two mils and approximately twelve mils.

The fibers 32 are impregnated and preferably covered with a plastic material 34 such as an acrylic. However, other suitable thermoplastic materials such as a nylon, a polycarbonate or ABS may also be used. Preferably the plastic material 34 covers the fibers by a particular distance such as approximately six mils (0.006") to approximately fifteen mils (0.015"). Preferably this distance is about ten mils (0.010"). The retention members 28 and 30 may be attached to the tuckboard 24 as by a thin coating 40 of a suitable adhesive such as an epoxy.

The apparatus 22 may be formed in one of two (2) alternative ways. In one alternative way, the tuckboard 24 and the retention members 28 and 30 may be separately shaped and the retention members 28 and 30 may then be adhered to the tuckboard. In the other alternative, the retention members 28 and 30 may be initially adhered to the tuckboard 24 and the resultant combination may be subsequently shaped. In either alternative, the retention members 28 and 30 are generally heated before shaping. In either alternative, the inner sole 25 and the outsole 26 are attached to the tuckboard 24 after the retention members 28 and 30 have been attached to the tuckboard and have been shaped. In this way, the inner sole 25 and the outsole 26 cover the tuckboard.

As will be appreciated, the attachment of the retention members 28 and 30 to the opposite surfaces of the tuckboard 24 provides the apparatus 22 with considerable rigidity and strength. This results in part from the fact that one of the retention member 28 and 30 is under compression and the other retention member is under tension. It also results in part from the fact that the formation of the retention members 28 and 30 from the composite of the fibers 32 and the plastic material 34 provides the retention members with light and strong and rigidifying properties even though the retention members are only a relatively few mils thick. The apparatus 22 also provides some torsional strength to the shoe.

FIGS. 5 and 6 illustrate another embodiment of the invention. In this embodiment, slits or holes 50 are provided at the upper and lower surfaces of the tuckboard 24. Several slits or holes 50 may be provided, each extending in a longitudinal direction and each extending into the tuckboard in a direction transverse (preferably perpendicular) to the surface of the tuckboard. A liquid adhesive 40 may be poured into the slits 50 and the retention members 28 and 30 may be disposed on the surfaces of the tuckboard 24 while the adhesive is tacky. When the adhesive has solidified, a strong support relationship is established between the tuckboard 24 and the retention members 28 and 30, partly as a result of the disposition of the adhesive 40 in the slits 50. This strong support results from the fact that the adhesive 40 in the slits 50 serves as an anchor to hold the retention members 28 and 30 in a fixed position on the tuckboard 24.

FIGS. 7 and 8 show that the disposition of the retention members, such as the members 28 and 30, on the tuckboard 24 is not limited to the arch support region 20 of the footwear. For example, the embodiment shown in FIGS. 7 and 8 is intended to be used in an athletic shoe particularly intended to be used on fields employing artificial turf. As shown in FIGS. 7 and 8, a pair of retention members 60 and 62 are disposed on the opposite surfaces of a tuckboard 64 at the forward tips of the tuckboard. Another pair of retention members 66 and 68 are disposed on the opposite surfaces of the tuckboard 24 at positions corresponding to the ball of a wearer's foot. The retention members 60, 62, 66 and 68 may be formed from the same material as the retention members 28 and 30 in this embodiment and the previous embodiments. The retention members 60, 62, 66 and 68 prevent the foot from twisting on artificial turf.

Although this invention has been disclosed and illustrated with reference to particular embodiments, the principles involved and susceptible for use in numerous other embodiments which will be apparent to persons skilled in the art. The invention is, therefore, to be limited only as indicated by the scope of the appended claims.

I claim:

1. In combination for providing support in the sole of footwear and for maintaining the sole of the footwear in a particular shape, a tuckboard made from a sheet of a material bendable in a particular configuration, the tuckboard having opposite surfaces, and a pair of retention members disposed on the opposite surfaces of the tuckboard, one in compression and the other in tension, to provide for the maintenance of the tuckboard in the particular shape, the tuckboard being slit on the opposite surfaces, and adhesive disposed on the surfaces of the tuckboard and in the slits and adhering the retention members to the tuckboard.

2. In combination for providing support in the sole of footwear and for maintaining the sole of the footwear in a particular shape, a tuckboard made from a sheet of a material bendable in a particular configuration, the tuckboard having opposite surfaces, and a pair of retention members disposed on the opposite surfaces of the tuckboard, one in compression and the other in tension, to provide for the maintenance of the tuckboard in the particular shape, an inner sole disposed on one surface of the tuckboard and an outsole disposed on the other surface of the tuckboard, the inner sole and the outsole covering the retention members, the tuckboard being slit on its opposite surfaces at positions corresponding to the disposition of the retention members on the tuckboard, and an adhesive in the slits and on the surfaces of the tuckboard and adhering the retention members to the tuckboard.

3. In combination for providing support in the sole of a footwear and for maintaining the sole of the footwear in a particular shape, a tuckboard made from a sheet of material bendable to conform to the shape of the sole of the shoe and to be disposed in the sole of the shoe, the tuckboard having opposite surfaces, and a pair of retention members disposed on the opposite surfaces of the tuckboard and having a combined thickness less than the thickness of the tuckboard and disposed at particular positions on the tuckboard to provide support and strength and rigidity to such positions, each of the retention members being formed from a sheet material and the combined thicknesses of the retention members being less than the thickness of the tuckboard, one of the retention members being under tension and the other retention member being under compression, each of the retention members being disposed only at localized positions on the opposite surfaces of the tuckboard where strength and rigidity is to be provided to the tuckboard, the tuckboard being slitted on its opposite surfaces at the positions of the retention members and an adhesive being disposed on the tuckboard at the positions of the retention members and in the slits and adhering the retention members to the tuckboard.

* * * * *